US007267920B2

(12) United States Patent
Nakazawa et al.

(10) Patent No.: US 7,267,920 B2
(45) Date of Patent: Sep. 11, 2007

(54) TONER FOR DEVELOPING ELECTROSTATIC LATENT IMAGES, PRODUCTION METHOD THEREOF, AND ELECTROSTATIC LATENT IMAGE DEVELOPER USING THE SAME

(75) Inventors: Hiroshi Nakazawa, Minamiashigara (JP); Yutaka Sugizaki, Minamiashigara (JP); Kazufumi Tomita, Minamiashigara (JP); Shuji Sato, Minamiashigara (JP); Akira Matsumoto, Minamiashigara (JP); Yosuke Tsurumi, Minamiashigara (JP); Masanobu Ninomiya, Minamiashigara (JP); Takao Ishiyama, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 387 days.

(21) Appl. No.: 10/936,603

(22) Filed: Sep. 9, 2004

(65) Prior Publication Data

US 2005/0175923 A1 Aug. 11, 2005

(30) Foreign Application Priority Data

Feb. 6, 2004 (JP) ..... 2004-030159

(51) Int. Cl.
*G03G 9/08* (2006.01)

(52) U.S. Cl. ..... 430/110.3; 430/108.8; 430/108.6; 430/111.4

(58) Field of Classification Search ..... 430/111.4, 430/110.3, 108.6, 108.8
See application file for complete search history.

(56) References Cited

U.S. PATENT DOCUMENTS

| | | | | |
|---|---|---|---|---|
| 6,115,575 | A | 9/2000 | Kinoshita et al. | |
| 6,733,944 | B2 * | 5/2004 | Kadokura et al. | 430/124 |
| 2005/0175920 | A1 * | 8/2005 | Tsurumi et al. | 430/108.8 |

FOREIGN PATENT DOCUMENTS

| | | |
|---|---|---|
| EP | 1 439 429 A1 | 7/2004 |
| JP | A 59-218459 | 12/1984 |
| JP | A 59-218460 | 12/1984 |
| JP | A 60-57954 | 4/1985 |
| JP | A 62-73276 | 4/1987 |
| JP | A 4-69666 | 3/1992 |
| JP | A 5-27476 | 2/1993 |
| JP | A 5-61239 | 3/1993 |
| JP | A 6-250439 | 9/1994 |
| JP | A 9-258481 | 10/1997 |
| JP | A 2004-85850 | 3/2004 |
| JP | A 2005-3751 | 1/2005 |

* cited by examiner

*Primary Examiner*—John L Goodrow
(74) *Attorney, Agent, or Firm*—Oliff & Berridge, PLC

(57) ABSTRACT

The present invention provides a toner for developing an electrostatic latent image comprising of: toner particles containing at least a binder resin, a colorant and a releasing agent; wherein a volume-average particle diameter of the toner particles is in a range of about 5 to 8 μm; an average of shape factor SF1 of the toner particles is in a range of about 125 to 140; and an arithmetical mean undulation height of the surface of the toner particles at the 90% point on the cumulative distribution curve is in a range of about 0.15 to 0.25 μm. Further, the present invention provides an electrostatic latent image developer containing the toner. The invention also provides a method for producing the toner.

18 Claims, 1 Drawing Sheet

TONER FOR DEVELOPING ELECTROSTATIC LATENT IMAGES, PRODUCTION METHOD THEREOF, AND ELECTROSTATIC LATENT IMAGE DEVELOPER USING THE SAME

CROSS-REFERENCE TO RELATED APPLICATION

This application claims benefit of priority under 35 USC 119 from Japanese Patent Application No. 2004-30159, the disclosure of which is incorporated by reference herein.

BACKGROUND OF THE INVENTION

1. Field of the Invention

The present invention relates to: a toner, for developing electrostatic latent images in electrophotography, electrostatic recording, and other processes; a production method thereof; and an electrostatic latent image developer using the same.

2. Description of the Related Art

Methods of visualizing image information via electrostatic latent images in the electrophotographic and other processes have been widely used in various applications. In these methods, visualization is realized by forming a latent electrostatic image on a photoreceptor (latent image bearing body) by charging/exposing in a electrophotographic process. This latent image is developed with an electrostatic latent image developer (hereinafter, referred to as "developer") containing a toner for developing electrostatic latent images (hereinafter, referred to as "toner"), and transferred to and fixed on a recording medium. The developers used in these methods include: two-component developers, containing of a toner and a carrier; and one-component developers, containing only a magnetic or nonmagnetic toner.

Such toners are commonly produced in a kneading-pulverizing process, wherein a plastic resin is melt-kneaded with a pigment, an electrostatic charge-controlling agent, and a releasing agent (such as a wax) are then cooled, pulverized, and classified. Inorganic and organic particles are sometimes added to the surface of the toner particles to improve fluidity and cleaning property.

The recent move towards an information-society has driven a need for providing high quality images in documents by means. Hence intensive research has been conducted into improving the quality of images formed in various image forming processes. There is of course the same demand in the electrophotographic image forming process and, particularly in the electrophotographic process, there exists a need for a toner having a smaller diameter, and a narrower grain size distribution in order to produce images of higher definition.

However, with the kneading-pulverizing process commonly practiced in toner producer, there is a problem during pulverization and classification. A great amount of energy is required for the pulverization and this increases the cohesiveness of the toner particles, causing problems in the classification, particularly of particles. Thus the conventional process cannot satisfy the need for a reduction in the size of toner particles. In addition, the shape and the surface structure of such toner particles are irregular and, whilst slight variations can be made depending on the pulverization characteristics of the materials used and the conditions of the pulverization process, it is practically impossible to control the shape and surface structure of the intended toners deliberately.

Further, there is a restriction in selecting materials for use in the kneading-pulverizing process. More specifically, the resin/colorant dispersion should be brittle enough that the mixture can be pulverized into particles in economically feasible manufacturing equipment, However if the resin/colorant dispersion is brittle, the particles formed may be further pulverized into even finer particles by the mechanical shearing force applied in developing devices. As a result of these influences the following occur more readily: in the case of a two-component developer, the finer particles thus generated adhere to the surface of the carrier, accelerating charge degradation of the developer; while in the case of a one-component developer, the resulting expansion of the grain size distribution causes scattering of the toner and also changes in toner shape cause a deterioration in image quality due to the decrease in developing property of the toner.

When considerable amounts of a releasing agent such as a wax is added internally for production of a toner, the exposure of the releasing agent at the surface of the thermoplastic resin increases, depending on the combination thereof. In particular, use of a combination of a high molecular weight component resin which is high in elasticity, and thus less pulverable, together with a brittle wax, such as polyethylene or polypropylene, often results in increased exposure of the wax component on the surface of the toner. Such exposure is rather advantageous for the release during fixation and for cleaning of the untransferred toner from the photoreceptor. However the polyethylene on the surface is easily transferred by mechanical force onto the developing roll and the photoreceptor, making staining of the carrier more likely and reducing reliability.

In addition, such toners often do not flow sufficiently even with an addition of a flow-improving agent, since the toner shape is irregular, and so there is migration of the flow-improving agent into cavities on the toner surface due to the mechanical shearing force during use. This causes a decrease in fluidity over time, while the embedding of the flow-improving agent into the toner leads to a reduction in the developing, transfer, and cleaning properties of the toner. Further, reuse in the developing apparatus of the toner recovered in the cleaning unit often leads to a deterioration in image quality. Addition of a greater amount of the flow-improving agent to prevent of these problems causes staining, filming, blemishes, and the like on the surface of the photoreceptor.

Accordingly, various processes for producing toners different from the kneading-pulverizing process, employing various polymerization methods such as a suspension polymerization process and the like, have been examined [see e.g., Japanese Patent Application Laid-Open (JP-A) Nos. 60-57954, 62-73276, and 5-27476], and recently, a process for producing toners systematically by an emulsion polymerization aggregation method is proposed, as the means of controlling the shape and surface structure of toners (see e.g., JP-A No. 6-250439). Generally according to these methods toners are produced by: preparing a dispersion of resin particles by polymerization, for example, emulsion polymerization or the like; separately, preparing a colorant particle dispersion wherein a colorant is dispersed in a solvent; mixing these dispersions; aggregating the resin particles and the colorant particles together and growing the aggregated particles to a desired particle diameter by heating and/or pH adjustment, addition of a coagulant, or the like; then, stabilizing the aggregated particles at the desired particle diameter; and then, heating and coalescing the particles at a temperature of the glass transition point of the resin particles or higher.

The toner particles obtained in the emulsion polymerization aggregation process have extremely favorable properties (in particular, a narrower grain size distribution eliminating a need for classification), compared to those of the conventional toner particles obtained by the suspension polymerization process or other polymerization processes. The use of these particles as a toner allows the formation of high quality images over an extended period of time. In addition, the toner production process by the emulsion polymerization aggregation method, wherein the aggregated particles are heated and coalesced at a temperature of the glass transition point (Tg) of the resin particles or more, allows production of toners of a variety of different shapes from amorphous to spherical, by proper choice of the heating method and proper pH adjustment. Accordingly, it becomes possible to select the shape of the toners tailored to the specific electrophotographic system used, in the range from so-called potato-shaped to spherical.

On the other hand, when considering the reliable reproducibility of electrostatic latent images small diameter spherical toners with weaker adhering forces and superior developing and transfer properties have been favored. But when used in a relatively inexpensive blade-cleaning system wherein the toner remaining after transfer on the latent image bearing body is cleaned by a blade, these smaller spherical toners are inferior in cleaning, often causing problems such as black lines, colored lines, and the like due to improper cleaning. Amorphous toners are superior in cleaning with in the blade-cleaning system, but the transfer and developing properties gradually decrease because of the migration of the external additives into the cavities of toners, and local embedding of the external additives in the toners due to the stress in the developing device. This leads to problems such as: deterioration in image quality; generation of fogging of the substrate; increase in the amount of toner consumed, due to decrease in transfer efficiency; and the like.

For the reason above, potato-shaped toners (shape factor SF1 (described below): 125 to 140) are widely used in the electrophotographic systems employing the relatively inexpensive blade-cleaning system. However, from the viewpoint of particle shape, the potato-shape particles have a wide shape distribution, and, as it is impossible to control each of the shape and the uniformity of surface of the toner separately. The particles hence have wider ranges of distribution in shape and in the degree of uniformity of surface. The potato-shaped particles contain both incompletely coalesced particles, having irregular surfaces, and completely coalesced particles having a smooth surface. Even in the emulsion polymerization aggregation process wherein the diameter and the shape of toner particles are controllable more easily than in other production processes, it is very difficult to control the surface properties of toners at will. Also because only toners in a very narrow region of shapes can satisfy all of the requirements for developing, transfer, and cleaning properties, very exact control of the production conditions is required.

Considering recent demands for higher speeds and lower energy consuming devices, toners having uniform electrostatic propensity, durability, higher toner strength, and narrower grain size distribution are becoming more and more important. Also the need to improve speed whilst reducing the energy consumption of these devises indicates that it is necessary to fix images at even lower temperatures. A releasing agent component is added to the toner for the purpose of improving the image fixing properties, and a polyolefin-based wax is commonly added internally as the releasing agent component for prevention of low-temperature offsetting during fixing. In addition, a small amount of silicone oil is applied uniformly on the fixing roller for improvement in high-temperature offset ability. As a result, the silicone oil components are adhered to the surface of the output recording body, making it sticky, or the like, and unpleasant to handle.

To solve the problem, an oil-less fixing toner, containing a great amount of a releasing agent component, is proposed (see e.g., JP-A No. 5-61239). However, although the addition of a large amount of releasing agent is effective to some extent in improving the high-temperature offset ability, the binder resin component and the releasing agent are mutually compatible, prohibiting consistent and uniform release of the releasing agent and thus stability in high-temperature offset resistance is not easily obtained. Because the cohesiveness of the binder resin in the toner is governed by the weight-average molecular weight (Mw) and Tg of the binder resin, it is difficult to control the internal and surface structures of the releasing agent wax at the same time, and thus it is practically impossible to control directly the stringiness, cohesiveness, and high-temperature offset ability of the toner during fixing. Further, liberated components from the releasing agent may sometimes cause inhibition of charging.

To overcome these problems, some methods of compensating for the rigidity of binder resin by an addition of high-molecular weight component or the introduction of chemical crosslinking is proposed. This has the effect of reducing the stringiness of toner at the fixing temperature and improves the high-temperature offset ability in the oil-less fixer (see e.g., JP-A Nos. 4-69666, 9-258481, 59-218459, and 59-218460). However, when simply a crosslinking agent component is added to the binder resin, the viscosity of toner, i.e., the cohesive forces in the molten state, increases and the rigidity of the binder resin increases. Whilst the temperature related dependency, toner load related dependency, and the like of oil-less fixing may be improved to some extent, as a result of the increased rigidity flexural resistance to bending of fixed images declines. It becomes practically impossible to control together both the temperature and the toner load related dependencies of peeling. In particular, when used in an energy-saving type fixing device processing at low temperature and low pressure, or an copying machine or printer having a higher printing speed, such toners cannot really provide satisfactory fixed images.

As described above, currently, there are no toners produced in any one production processes, including the kneading-pulverizing process, suspension polymerization process, and emulsion polymerization aggregation process, which can satisfy all the requirements for fixability, image quality, developing consistency and developing, transferring and cleaning properties.

SUMMARY OF THE INVENTION

The present invention has been made in view of the above circumstances and provides a toner for developing electrostatic latent images, a production method thereof, and an electrostatic latent image developer using the same.

The invention provides a toner for developing electrostatic latent images: superior in electrostatic propensity and transfer properties when used in a wide range of image forming processes from low to high speed;

with fewer fluctuations in the temperature at which offset occurs during oil-less fixing; and superior in cleaning, allowing the removing of the toner remaining on the photoreceptor by a blade cleaning method, over an extended period of time; as well as a production method thereof; and an electrostatic latent image developer using the same.

After intensive studies to solve the problems above, the present inventors have found that it is possible to provide a toner superior in developing, transfer, and cleaning properties by: controlling the volume-average particle diameter and the shape factor SF1 of an electrophotographic toner, which contains at least a binder resin, a colorant, and a releasing agent; and controlling the value of the arithmetical mean undulation height of the surface of the toner particles at the 90% point on the cumulative distribution curve thereof (hereinafter, occasionally referred to as "lubricity"). And the inventors have found that using the above toner, durable images with lower density fluctuations, lower fogging, less deterioration in image quality, and fewer defects such as colored lines or the like can be provided over an extended period of time.

It has also been found that use of a paraffin wax having a melting point in a defined range as the releasing agent, together with a toner according to the invention having preferable surface properties, allows production of a toner having a wider latitude in shape even in the smaller-diameter region (i.e., superior in developing, transfer, and cleaning properties) and also provides a preferable fixability (i.e., superior in high-temperature offset ability).

The inventors have also found that by employing an emulsification aggregation coalescence process as the method of producing the toner according to the present invention, and adjusting in particular ranges the properties of the materials used and the production conditions of that process, it is possible to control both the shape and the surface properties of the resulting toner independently, producing toners with a wider latitude in shape when considering the developing, transfer, and cleaning properties.

Namely, a first aspect of the present invention is to provide toner for developing an electrostatic latent image comprising of toner particles comprising a binder resin, a colorant and a releasing agent, wherein: a volume-average particle diameter of the toner particles is in a range of about 5 to 8 μm and an average of shape factor SF1 thereof is in a range of about 125 to 140; and an arithmetical mean undulation height of the surface of the toner particles at the 90% point on the cumulative distribution curve is in a range of about 0.15 to 0.25 μm.

A second aspect of the invention is to provide an electrostatic latent image developer comprising the toner.

Further, a third aspect of the invention is to provide a method for producing the toner, comprising: mixing a resin particle dispersion, containing resin particles having a volume-average particle diameter of 1 μm or less, a colorant particle dispersion, and a releasing agent particle dispersion; forming aggregated particles by aggregating the resin particles, the colorant particles, and the releasing agent particles by heating; forming toner particles by heating and coalescing the aggregated particles at a temperature of the glass transition point of the resin particles or higher.

BRIEF DESCRIPTION OF THE DRAWING

Preferable embodiments of the present invention will be described in detail based on the following figure.

DETAILED DESCRIPTION OF THE INVENTION

Figure 1:
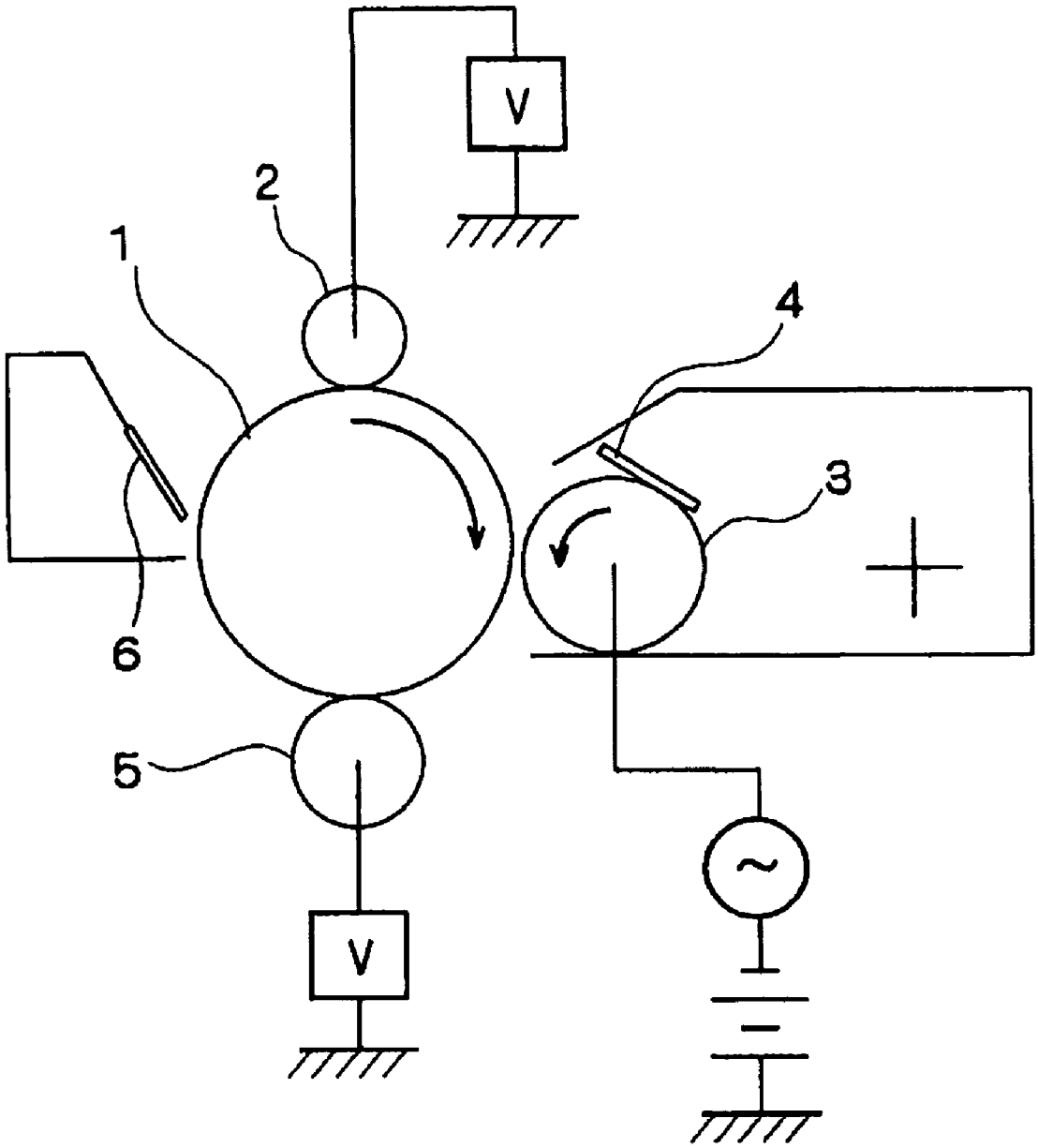
FIG. 1 is a schematic view of an image forming apparatus used in evaluation of an electrostatic latent image developer according to the invention.

The present invention enables easy provision of a toner for developing electrostatic latent images which, when used in a wide range of electrostatic imaging processes from low- to high-speed is: superior in electrostatic propensity and transfer properties, eliminating scattering; provides sharp definitition images; has superior cleaning characteristics eliminating incidences of defects in image quality due to improper cleaning, such as black lines and others, over an extended period of time; and provides superior fixing characteristics in oil-less fixing, such as hot off-set resistance. The invention provides a production method for the above toner, and an electrostatic latent image developer using the same.

Hereinafter, the invention will be described in detail. Toner for developing electrostatic latent images and the production method thereof.

The toner for developing electrostatic latent images according to the invention is used in an image forming apparatus in a process having at least: latent image forming, wherein a latent image is formed on a latent image bearing body, developing wherein the latent image on the latent image bearing body is developed with a thin layer of a developer formed on a developer bearing body; transferring wherein the toner image formed on the latent image bearing body is transferred onto a transfer body; fixing wherein the toner image formed on the transfer body is heat fixed, and cleaning wherein the toner remaining after transfer on the latent image bearing body is removed by a blade.

The toner for developing electrostatic latent images according to the invention is a toner containing at least a binder resin, a colorant and a releasing agent, wherein: the volume-average particle diameter is in a range of about 5 to 8 μm; the average of shape factor SF1 is in a range of about 125 to 140, and the arithmetical mean undulation height of the surface of the toner particles at the 90% point on the cumulative distribution curve is in a range of about 0.15 to 0.25 μm.

The toner according to the invention can satisfy all requirements regarding properties, including developing, transfer, cleaning properties, and the like, has better than before. This is done by controlling the diameter and the shape of toner particles, as well as the arithmetical mean undulation height of the surface of the toner particles at the 90% point on the cumulative distribution curve thereof, an index of the uniformity of toner surface roughness.

Generally the developing, transfer, and cleaning properties of a toner are influenced significantly by the diameter and the shape of toner particles. The developing property shows the extent of binding of a toner to the electrostatic latent image on the surface of the photoreceptor, and so if the amount of static charge on the particles is the same, toner particles larger in diameter are more easily developed. It is more advantageous that the shape factor SF1 of toner is smaller (nearly spherical), as the toner can be charged more uniformly with other charged elements such as the carrier. With regard to the transfer properties, it is advantageous that the contact area between the photoreceptor and the toner is small or the shape is nearly spherical, when images are transferred from the surface of the photoreceptor onto a paper (recording medium) or the like.

The shape factor SF1 is calculated according to the following Formula (2):

$$SF1=(ML^2/A)\times(\pi/4)\times 100 \qquad \text{Formula (2)}$$

In the Formula (2), ML represents the maximum length of a toner particle, and A represents the projected area of the toner particle.

The SF1 is determined mainly by analyzing microscopic images or scanning electron microscope (SEM) images in an image-analyzing instrument and calculating, for example, according to the following method. Namely, the SF1 is determined by incorporating optical microscopic images of toner particles spread on the surface of a slide glass into a Luzex image-analyzing instrument via a video camcorder, measuring the maximum lengths and projected areas of 50 or more toner particles, calculating the SF1 for each particle according to the Formula (2) and obtaining the averages thereof.

With regard to the cleaning characteristics, the toner particles are preferably amorphous, to prevent of the problem of toner particles sneaking by a blade in the blade-cleaning systems described above.

Regarding the diameter and the shape of the toner particles from the viewpoints above, the volume-average particle diameter of the toner is preferably in a range of about 5 to 8 μm, and the average of shape factor SF1 is in a range of about 125 to 140. However control of the volume-average particle diameter and the shape factor SF1 of toner particles alone may not provide toners superior in developing, transfer, and cleaning properties. Also even if obtainable, the control range may be extremely narrow, practically prohibiting production of such toners.

In particular, the shape factor SF1 of toner particles is determined based on the projected image as described above, and thus three-dimensional factors of the toner particles are not taken into consideration. Accordingly, toners having the same shape factor SF1 often lead to toners significantly different in transfer and cleaning properties.

A new control factor, arithmetical mean undulation height of the surface of the toner particles at the 90% point on the cumulative distribution curve, is introduced to the toner for developing electrostatic latent images according to the invention. Control of this value in a range of about 0.15 to 0.25 μm eliminates the above problem. Namely, the arithmetical mean undulation height of the surface of the toner particles at the 90% point on the cumulative distribution curve is an indicator representing the uniformity of the microroughness of toner surface. It has been found in the invention that this indicator is closely related to the actual binding state between the toner surface and the photoreceptor, which can not be explained by the shape factor SF1.

Specifically, control of the arithmetical mean undulation height of the surface of the toner particles at the 90% point on the cumulative distribution curve within the range above leads to a uniformization of the binding state between the toner surface and photoreceptor and other charged elements, which vary significantly even when the toners having the same shape factor SF1 are used. This leads to a significant increase in the latitude for controlling the shape of toner with the shape factor SF 1. Namely, if the volume-average particle diameter of toner particles is in a range of about 5 to 8 μm, the average of shape factor SF1, in a range of about 125 to 140, and the arithmetical mean undulation height of the toner particle surfaces at the 90% point on the cumulative distribution curve, in a range of about 0.15 to 0.25 μm, then it is possible: to accomplish the uniform electrification of toners with other charged elements required for developing; to obtain the suitable binding state between the toner and the photoreceptor, required for suitable transfer, whilst retaining a shape favorable for cleaning.

The toner for developing electrostatic latent images according to the invention should have a volume-average particle diameter in a range of about 5 to 8 μm to effectively acquire the above advantages. In addition, the volume-average particle diameter thereof is preferably in a range of about 5 to 7 μm, more preferably in a range of about 5.5 to 7 μm, for obtaining all of the desirable developing, transfer, and cleaning properties at the same time. A volume-average particle diameter of toner particles of less than 5 μm not only deteriorates the cleaning properties of the toner, but can also lead to the appearance of a decrease in the developing, and transfer properties due to excessive charging. Background fogging and a deterioration in image quality due to low transfer efficiency can occur and, when a two-component developer is used, it may lead to carrier staining and toner staining from the external fluidity improvement additives making the formation of favorable images for an extended period of time is difficult. Also, if the volume-average particle diameter is more than 8 μm, then it becomes more difficult to produce toner particles having an arithmetical mean undulation height of the surface of the toner particles at the 90% point on the cumulative distribution curve in a range of about 0.15 to 0.25 μm. Not only this but additionally the reliability of the reproduction of the electrostatic latent image formed on the photoreceptor starts to decline, due to scattering of the toner particles, resulting in the formation of inferior images in thin line reproducibility, graininess, and the like.

For obtaining favorable transfer and cleaning properties, the average of shape factor SF1 of toner particles is preferably in a range of about 125 to 135, and more preferably in a range of about 125 to 133. A shape factor SF1 of less than 125 leads to a reduction in the cleaning efficiency of residual toner after transfer, while a factor over 140 leads to a dramatic decrease in transfer property.

For the purpose of expanding the region wherein the toner is superior both in transfer and cleaning properties, the arithmetical mean undulation height of the surface of the toner particles at the 90% point on the cumulative distribution curve is preferably in a range of about 0.17 to 0.23 μm, and more preferably in a range of about 0.18 to 0.20 μm. An arithmetical mean undulation height of the surface of the toner particles at the 90% point on the cumulative distribution curve of less than 0.15 μm leads to reduced cleaning and the appearance of image defects such as black lines and the like. At the other extreme, if it is more than 0.25 μm, the transfer property of the toner decreases dramatically. Together with this the developing property also decreases because of external additives, especially smaller-diameter external additives added for the purpose of fluidization, migrating into the cavities on the toner surface. The consequence is an increase in the amount of the toner consumed and leads to an uneven distribution of static charge, and thus to staining of the interior of image forming apparatuses and generation of higher fogging due to scattering of toner particles.

The method of determining the arithmetical mean undulation height of the surface of the toner particles at the 90% point on the cumulative distribution curve will be described later.

Any known releasing agent may be used as the releasing agent for the toner according to the invention. Examples of releasing agents include: low-molecular weight polyolefins such as polyethylene, polypropylene, and polybutene and the like; silicones that soften easily by heating; fatty acid amides such as oleic amide, erucic amide, recinoleic amide, stearic amide and the like; plant waxes such as carnauba wax, rice wax, candelilla wax, Japan tallow, jojoba oil and the like; animal waxes such as bee wax and the like; mineral-petroleum waxes and synthetic waxes such as montan wax, ozokerite, ceresin, paraffin wax, microcrystalline wax, Fischer-Tropsch wax and the like; and the modified materials thereof.

Among known releasing agents, paraffin waxes having a melting point in a range of about 75 to 100° C. are preferable, since the use of these waxes gives a significant fixing characteristics, especially the offsetting properties in high-temperature regions. Further, the melting point thereof is more preferably in a range of about 80 to 100° C.

In addition to the paraffin waxes above, use of Fischer-Tropsch waxes, especially those having a melting point in a range of about 75 to 100° C., gives superior offset properties in high-temperature regions and, together with good blade cleaning, in image forming apparatuses operating at any processing speeds from low- to high-speed. Further, the melting point is more preferably in a range of about 80 to 100° C.

Use of a wax other than the paraffin or Fischer-Tropsch wax above may result in being unable to give satisfactory fixing characteristics in all regions from low- to high-speed regions. For example, those that are suitable at low-speed but not in high-speed processing.

If the melting point is less than 75° C., then higher incidence of low-density images may result due to difficulties in dispensing toner caused by a deterioration in storage stability and fluidity. Image defects such as white lines, caused by clogging of the trimmer portions due to solidification of the toner may also result. If the melting point is more than 100° C. or if the releasing agent is a different type to the above, then it may be impossible to satisfy the requirements for fixing in all low- to high-speed operating regions. Also it may lead to a higher incidence of high-temperature offsets, due to poor exudation of the releasing agent onto the surface of fixed images.

The amount of the releasing agent added is preferably in a range of about 5 to 20% by weight, more preferably in a range of about 7 to 13% by weight with respect to the total amount of the toner. An added amount of less than 5% by weight may lead to the occurrence of high-temperature offsets, while an added amount of over 20% by weight may lead to a decrease in toner fluidity, even when the surface of the releasing agent is covered by binder resin.

Hereinafter, processes for producing the toner for developing electrostatic latent images according to the invention will be described, together with the composition of the toner.

The toners for developing electrostatic latent images according to the invention may be produced in any processes including kneading-pulverizing, suspension polymerization, solubilization dispersion, and emulsification aggregation coalescence and the like. However the emulsification aggregation coalescence process is more preferable, as the toners obtained thereby have a narrower grain size distribution, thus the requirement for a classification operation can be eliminated in some cases. Further this process is more preferable from the viewpoint of controllability of toner shape and toner surface properties.

The emulsification aggregation coalescence process is a method of obtaining toner particles by: mixing a dispersion of resin particles, prepared by emulsion polymerization or the like, together with a colorant particle dispersion, and a releasing agent particle dispersion; aggregating the resin particles, colorant particles, and releasing agent particles into aggregated particles having a diameter similar to that of the toner particles by heating of the dispersion, or combined and pH adjustment and/or addition of an coagulant (at least by heating); and then heating and coalescing the resulting aggregated particles at a temperature of the glass transition of the resin particles or higher.

Additives may also be added during the aggregation such as: inorganic oxides, for the purpose of providing the resulting toner with resin elasticity; dispersions of charge controlling agents, for the purpose of charge control; and the like. Further, a resin particle dispersion may also be added for the purpose of eliminating exposure of the colorant, releasing agent, and the like on the surface of toner. The process of binding and coalescing the resin particles in order to reduce the amount of coloring and releasing agents exposed on surface is particularly favorable, since it increases the fluidity of toners, and decreases the dependence of electrostatic charging on environmental factors.

The resin (binder resin) used in the resin particles is not particularly limited, but examples which can be given are a thermoplastic resin or the like. Specific examples thereof include polymers from monomers including: styrenes such as styrene, p-chlorostyrene, α-methylstyrene, and the like; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, and the like; vinyl nitriles such as acrylonitrile, methacrylonitrile, and the like; vinyl ethers such as vinylmethylether, vinylisobutylether, and the like; vinyl ketones such as vinylmethylketone, vinylethylketone, vinylisopropenylketone, and the like; polyolefins such as ethylene, propylene, butadiene, and the like; and similar monomers. In addition, crosslinking components, including for example, acrylic esters such as pentanediol diacrylate, hexanediol diacrylate, decanediol diacrylate, nonanediol diacrylates and the like can be used.

In addition to the polymers from the monomers above, examples can be given of suitable copolymers of two or more monomers, or mixtures thereof such as; non-vinyl condensation resins such as epoxy resins, polyester resins, polyurethane resins, polyamide resins, cellulose resins, polyether resins and the like; mixtures thereof with the vinyl resins above; graft polymers obtained by polymerization of the vinyl monomers above in the presence of these resins; and the like.

The resin particle dispersions according to the invention can easily be prepared by an emulsion polymerization process or by a similar polymerization process employing a heterogeneous dispersion. Alternatively such dispersions may be prepared by any other processes, including those wherein a homogeneous polymer, previously prepared by solution polymerization, mass polymerization, or the like, is added together with a stabilizer into a solvent that does not dissolve the polymer and mechanically mixed and dispersed.

For example, if a vinyl monomer is used, it is possible to prepare a resin particle dispersion by emulsion or suspension polymerization of the monomer, in the presence of a suitable ionic surfactant or the like depending on the process. If another resin is used and the resin is oily and soluble in a solvent that is relatively nonmiscible with water, it is possible to prepare the resin particle dispersion by: dissolving the resin in the solvent; dispersing the solution in water together with an ionic surfactant and/or a high polymer electrolyte by means of a dispersing machine such as a homogenizer or the like and forming particles thereof in water; and then removing the solvent by heating or transpiration under reduced pressure.

Volume-average particle diameter of the resin particles in the resin particle dispersion according to the invention is 1 μm or less, preferably in a range of about 100 to 800 nm. A volume-average particle diameter of over 1 μm tends to lead to an expansion of the grain size distribution of the toner particles obtained by aggregation coalescing and a generation of free particles. Consequently this can lead to s deterioration in the properties and reliability of the resulting toner. If the volume-average particle diameter is less than 100 nm, it takes an extended period to complete aggregation and coalescence of the toner particles, and this is not suitable for commercial production. While if it is over 800 nm, it may become more difficult to disperse the releasing agent and the colorant uniformly and to control the toner surface properties.

Examples of the surfactants include, but are not particularly limited to, anionic surfactant such as sulfuric acid ester salts, phosphoric acid esters, soaps and the like; and cationic surfactants such as amine salts and quaternary ammonium salts and the like; nonionic surfactants such as polyethylene glycol surfactants, alkylphenol ethylene oxide adduct surfactants, alkylalcohol ethylene oxide adduct surfactants, and polyvalent alcohol surfactants; various graft polymers; and the like.

Production of the resin particle dispersion in the emulsion polymerization process is especially preferable, as it permits soap-free polymerization by adding a small amount of an unsaturated acid, such as acrylic acid, methacrylic acid, maleic acid, styrenesulfonic acid, or the like, and forming protective colloid layers.

The glass transition point of the resin particles used in the invention is preferably in a range of about 45 to 60° C. It is more preferably in a range of about 50 to 60° C. and still more preferably in a range of about 53 to 60° C. If the glass transition point is below 45° C., the toner powder tends to block because of heat, while if it is more than 60° C., the fixing temperature of the toner powder may become excessively high.

The weight-average molecular weight Mw of the resin particles used in the invention is preferably in a range of about 15,000 to 60,000, more preferably in a range of about 20,000 to 50,000, and still more preferably in a range of about 25,000 to 40,000.

If the weight-average molecular weight Mw is larger than 60,000, the viscoelasticity of the resulting toner is not only higher, raising the fixing temperature thereof, but it also makes it difficult to obtain the smooth fixed image surface required for high gloss. While if the weight-average molecular weight Mw is smaller than 15,000, the toner has a lower melt viscosity during fixing and a poor cohesive capacity, leading to a higher incidence of hot offsetting.

The processes for producing the toner for developing electrostatic latent images according to the invention are not limited to the emulsion polymerization process but for other processes, the favorable glass transition point and the favorable weight-average molecular weight should also be as in the ranges above.

It is possible to prepare a releasing agent particle dispersion containing releasing agent particles having a volume-average particle diameter of 1 μm or less, using a releasing agent described above, by the following: dispersing the releasing agent in water together with a polymer electrolyte such as an ionic surfactant, polymeric acid, polymeric base, or the like; heating the mixture at a temperature of the melting point of the releasing agent or more; and, at the same time, placing in a homogenizer or high-pressure discharge dispersing machine having a sufficiently great shearing force.

More preferable, the volume-average particle diameter of releasing agent particles is in a range of about 100 to 500 nm. If the volume-average particle diameter is less than 100 nm, it becomes generally more difficult for the releasing agent to be incorporated into the toner, although it depends on the properties of the resin used. And if it is more than 500 nm, then it may be less easy to get a good dispersion of the releasing agent in the toner. These releasing agent particles may be added together with other resin particle components into a mixing solvent all at once or gradually in aliquots.

Examples of the colorants used in the invention include: various pigments such as carbon black, chromium yellow, Hanza Yellow, benzidine yellow, threne yellow, quinoline yellow, permanent yellow, Permanent Orange GTR, pyrazolone orange, Vulcan Orange, Watchung Red, Permanent Red, Brilliant Carmine 3B, Brilliant Carmine 6B, Du Pont Oil Red, pyrazolone red, Lithol Red, Rhodamine B Lake, Lake Red C, rose bengal, aniline blue, ultramarine blue, Calco Oil Blue, methylene blue chloride, phthalocyanine blue, phthalocyanine green, malachite green oxalate and the like; various dyes such as acridine dyes, xanthene dyes, azo dyes, benzoquinone dyes, azine dyes, anthraquinone dyes, dioxazine dyes, thiazine dyes, azomethine dyes, indigo dyes, thioindigo dyes, phthalocyanine dyes, triphenylmethane dyes, diphenylmethane dyes, thiazine dyes, thiazole dyes, xanthene dyes, and the like. These colorants may be used alone or in combination of two or more.

In addition, magnetic powders including ferrite, magnetite, reduced iron, metals such as cobalt, nickel, and manganese, the alloys thereof, or the compounds containing these metals are used for magnetic toners.

Any common dispersing means, including rotary-shearing homogenizers and dispersers using a dispersion medium such as ball mill, sand mill, Dyno-mill, and Ultimizer, may be used for dispersing the colorant, and thus the dispersion method is not particularly restricted.

Specifically, the colorant is dispersed in water together with a polymer electrolyte such as an ionic surfactant, polymeric acid, polymeric base, or the like. The volume-average particle diameter of the colorant particles dispersed should be 1 μm or less, but preferably in a range of about 80 to 500 nm, as the colorant is more favorably dispersed in toner without impairing the cohesiveness.

Each of the volume-average particle diameters described above can be determined, for example, by using a laser-diffraction grain size distribution analyzer, centrifugal grain size distribution analyzer, or the like.

In the invention, depending on the application, in addition to the resin particle, colorant particle, and releasing agent particle, other components (particles) may be added such as: an internal additives; charge controlling agents; inorganic particles; organic particles; lubricants; abrasives; and the like. The particles above may be added into the resin particle dispersion, colorant particle dispersion, and/or releasing agent particle dispersion. Alternatively, a dispersion of the particles above may be added to and blended in the mixture of the resin particle dispersion, colorant particle dispersion, and releasing agent particle dispersion.

The internal additives include, for example, magnetic particles such as ferrite, magnetite, reduced iron, metals such as cobalt, manganese, and nickel, the alloys thereof, the compounds containing these metals, and the like, and are preferably used in the amount that does not impair the electrostatic propensity of the toner.

The charge controlling agents are not particularly limited, but are preferably colorless or palely colored, especially for color toners. Examples thereof include dyes of quaternary ammonium salt compounds; nigrosin compounds; the complex compounds of aluminum, iron, and chromium; triphenylmethane pigments; and the like.

Examples of the inorganic particles commonly used as external additives for the toner surface are: silica, titania, calcium carbonate, magnesium carbonate, tricalcium phosphate, cerium oxide, and the like. Examples of the organic particles commonly used as external additives for the toner surface are any particles, such as vinyl resins, polyester resins, and silicone resins. These inorganic and organic particles may be used as flow-improving agent, cleaning agents, or the like.

Examples of the lubricants include fatty amides such as ethylene bisstearic amide and oleic amide; fatty acid metal salts such as zinc stearate and calcium stearate; and the like. Further, examples of abrasives described above include silica, alumina, cerium oxide, and the like.

When the resin particles, colorant particles, and releasing agent particles are mixed, the content of the colorant particles is 50% by weight or less, and preferably in a range of about 2 to 40% by weight.

The content of the other components is an amount that does not impair the object of the invention, and generally a small amount. Specifically, it is in a range of about 0.01 to 5% by weight, preferably in a range of about 0.5 to 2% by weight.

Dispersion media used for the resin particle dispersion, colorant particle dispersion, releasing agent particle dispersion, and the dispersion of other components according to the invention are, for example, aqueous media. The aqueous media include, for example, water such as distilled water, ion-exchange water, or the like; alcohols; and the like. These dispersion media may be used alone or in combination of two or more.

Surfactants and bivalent or higher-valent inorganic metal salts having a charge opposite to that of the surfactant used in the resin particle dispersion and colored particle dispersion are favorably used as the coagulants according to the invention. Inorganic metal salts are particularly favorable, as they allow a reduction in the amount of surfactants used and an improvement in the electrostatic properties of the resulting toner.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide; and the like. In particular, aluminum salts and the polymers thereof are favorable among them. For obtaining a narrower grain size distribution, it is preferable to use a higher-valent inorganic metal salt, i.e., bivalent is better than monovalent, trivalent is better than bivalent, tetravalent is better than trivalent, and preferable to use a polymeric inorganic metal salt polymer rather than a low-molecular weight metal salt if the valency is the same.

The amount of the coagulant to be added varies according to the ionic concentration during aggregation, but is preferably in a range of about 0.05 to 1.00% by weight, more preferably in a range of about 0.10 to 0.50% by weight with respect to the total solid matters (toner components) in the mixing solution. If the addition amount is less than 0.05% by weight, there may be fewer advantageous effects of using the coagulant, while if it is more than 1.00% by weight, there may be over-aggregation of the toner, sometimes causing image defects due to improper transfer.

The toner for developing electrostatic latent images according to the invention having the superior properties described above may be produced, for example, according to the following.

The toners having a desirable particle shape and favorable surface properties may be produced by: aggregating resin particles, colorant particles, and releasing agent particles by heating or combined heating and pH adjustment of the dispersion and/or addition of an coagulant (at least by heating); stabilizing the particle diameter of the aggregated particles by pH adjustment; and heating and coalescing the aggregated particles at a temperature of the glass transition temperature of the resin particles Tg or more, while suitably controlling the coalescing temperature Tf, the coalescing time t, and the pH of the dispersion.

In the emulsion polymerization aggregation process, the toner shape can be independently controlled by adjustment of the pH, while the toner surface is controlled by adjustment of the coalescing temperature and coalescing time. With regard to the toner surface, the coalescing temperature and the coalescing time suitable for obtaining the desired surface characteristics varies according to the melting point of the releasing agent used. Therefore, it is necessary to adjust the coalescing temperature and time, according to the melting point of the releasing agent used, to ensure reliable production of the toner having the unique properties according to the invention.

In the invention, it has been found that in producing toners containing various releasing agents in the emulsion polymerization aggregation process, it is possible to have a wider latitude in obtain a toner having a desirable developing, transfer, and cleaning properties, and production stability. This is done by ensuring a parameter P, which is a function of a shape factor SF1 and controlled by pH, a melting point of the releasing agent used Tm, the coalescing temperature Tf and the coalescing time t, is in the range expressed in the following Formula (1).

$$245 \leqq P \leqq 290 \quad (1)$$

In the Formula (1), P is $(2.137 \times SF1)-(0.003 \times (Tf-Tm) \times t)$. The units of Tf and Tm are ° C., and the unit of t is minute.

If P is greater than 290 (i.e., the shape is nearly amorphous and the uniformity of surface roughness is low), then the toner is inferior in developing and transfer properties. This can leads to an increase in the amount of the toner consumed and deterioration in image quality, with defects such as fogging and the like. However, if P is smaller than 245 (i.e., the shape is nearly spherical and the uniformity of surface roughness is high), then the toner may be less effectively removed in a blade-cleaning system, which can lead to defects in image quality due to improper cleaning.

Specifically, it is preferable to control the pH of the reaction system during coalescence in a range of about 4.0 to 6.5, more preferably in a range of about 4.5 to 6.0 to ensure P is in the range shown in Formula (2). In addition, the difference between the coalescing temperature Tf and the releasing agent melting point Tm, (Tf−Tm), is preferably in a range of about 0 to 25° C. and more preferably in a range of about 5 to 15° C.

Further, the coalescing time t varies according to the actual values of the shape factor SF1 and Tf−Tm but is preferably in a range of about 30 to 1,200 minutes, and more preferably in a range of about 60 to 360 minutes.

After solid-liquid separation, by a process such as filtration or the like, washing and drying are carried out as required, and the coalesced particles are finally converted to toner particles. In such cases, it is preferable to wash the particles thoroughly to ensure the superior electrostatic properties and reliability of the final toner.

For example, if particles are washed with an acid solution such as nitric acid, sulfuric acid, and hydrochloric acid, or an alkaline solution such as, sodium hydroxide, and additionally washed with ion-exchange water and the like this is greatly increases the washing effectiveness. Any one of the drying methods commonly practiced including vibratory fluidized bed drying, spray drying, freeze drying, and flash jet drying, and the like may be used in the drying. The toner particles preferable have a water content of 2% or less, more preferably 1% or less by weight after drying.

Alternatively when the toner for developing electrostatic latent images according to the invention is produced in the kneading-pulverizing process, then the resin, colorant, releasing agent, and the like, as described in the emulsification aggregation coalescence process are first mixed in a mixer, such as Nauter mixer, Henschel mixer, or the like, and then kneeded an extruder or the like, such as in a uniaxial or biaxial extruding machine. Then, after rolling out and cooling, the resulting sheet is pulverized into particles in a mechanical crusher such as Type I mill, KTM, jet mill, or the like, or in an air stream pulverizer and subsequently classified. A classifier utilizing the Coanda effect, such as Elbow Jet or the like or an air classifier such as Turbo Classifier or AcuCut can be used.

The toner according to the invention can be produced by controlling the toner surface structure. For example, in the Elbow Jet mill, the air pressure in the raw material-supply port can be adjusted, alternatively in an air classifier, the toner surface can be controlled by adjusting the rotational frequency of the rotor and the temperature of the air supplied into the classifier. An inorganic oxide or the like may be additionally added externally as required in the similar manner to the emulsification aggregation coalescence process, and the particles may be screened or the like, and larger particles therein removed as required.

The toners obtained in the production process described above have desired properties if the arithmetical mean undulation height of the surface of the toner particles at the 90% point on the cumulative distribution curve thereof is in a range of about 0.15 to 0.25 μm, but the shape of the toner particles also changes at the same time. Therefore, the emulsification aggregation coalescence process is more preferable, as the shape and the surface properties of the particles are controllable independently therein. From the viewpoints of independent controllability of the shape and surface properties of particles, both the suspension polymerization process and the solubilization dispersion process are inferior to the emulsion polymerization aggregation process, and consequently inferior in image quality as well.

As described above, Tg of the toner according to the invention is preferably in a range of about 45 to 60° C., more preferably in a range of about 50 to 60° C., and still more preferably in a range of about 53 to 60° C. The arithmetical mean undulation height of the surface of the toner particles at the 90% point on the cumulative distribution curve, which is essential for the production of toner according to the invention, depends on the heat applied in the production of the toner. In the suspension polymerization process, the viscosity of the monomer at the time of polymerizxation has a great influence on the surface properties of suspension polymerization toners. The emulsion polymerization aggregation process, the viscosity during coalescing has a great influence on the surface properties of the toners prepared. These viscosities in turn depend on the Tg of the toner resin. In the kneading pulverizing process, the small amount of heat generated on the surface of the particles by the impact of pulverization influences the surface properties of the toner particles.

If Tg of the toner above is less than 45° C. it is easier to control the arithmetical mean undulation height of the surface of the toner particles at the 90% point on the cumulative distribution curve to within the preferable range, but it can become more difficult to maintain the particle diameter. If Tg is more than 60° C., a greater amount of energy may be required to maintain the arithmetical mean undulation height of the surface of the toner particles at the 90% point on the cumulative distribution curve to within the preferable range.

For the same reason as that described for Tg of the toner, the weight-average molecular weight of the toner according to the invention is preferably in a range of about 15,000 to 60,000, more preferably in a range of about 20,000 to 50,000, and still more preferably in a range of about 25,000 to 40,000. If the weight-average molecular weight is less than 15,000, whilst it is easier to control the median of the arithmetical mean undulation height of the surface of the toner particles at the 90% point on the cumulative distribution curve to within the preferable range, it becomes more difficult to maintain the particle diameter. If it is more than 60,000, a greater amount of energy may be required to maintain the arithmetical mean undulation height of the surface of the toner particles at the 90% point on the cumulative distribution curve to within preferable range.

For the purpose of adjusting the charges on the toner providing the toner with fluidity and charge exchange characteristics, and the like, an inorganic oxide such as silica, titania, or aluminum oxide may be added as required and adhered to the surface of the toner according to the invention. The blending of the inorganic oxide may be carried out, for example, in a mixer such as a V-type blender, Henschel mixer, Redige mixer, or the like. Other additives may also be added as required during the blending.

These additives include: fluidizing agents other than those described above; cleaning agents or transfer aids such as polystyrene particles, polymethyl methacrylate particles, polyvinylidene fluoride particles; and the like. Also there is no restriction against the removal as required of coarse particles in the toner by using an ultrasonic screen classifier, vibratory screen classifier, air screen classifier, or the like.

The toner according to the invention preferably has at least two or more kinds of metal oxide particles on the surface. When a metal oxide having a relatively smaller particle diameter (for improvement of the fluidity and developing property and the like of the toner) and another metal oxide having a larger particle diameter (for improvement in the transfer property of toner and the like) are added together, then these metal oxide particles exert a greater effect in improving the developing, transfer, and cleaning properties of the toner. Therefore, preferably 2 or more kinds of metal oxide particles, different in particle diameter, are added as external additives as described above.

The metal oxide particles added for improvement in fluidity preferably have an average particle diameter of about 1 to 40 nm, more preferably in a range of about 5 to 20 nm as a primary particle diameter. Alternatively, the metal oxide particles added for improvement in transfer property preferably have an average particle diameter in a range of about 50 to 500 nm.

If the arithmetical mean undulation height of the surface of the toner particles at the 90% point on the cumulative distribution curve is in a range of about 0.15 to 0.25 μm, then metal oxide particles having a smaller particle diameter migrate into the cavities of the toner under the action of stirring or the like, and hence do not impair the advantageous effects of external additives. At the same time, metal oxide particles having a larger particle diameter effectively prevent desorption caused by impact among toner particles or between the toner and charged elements, thus limiting a decrease in the transfer property.

Specific examples of the metal oxide particles include silica, titania, zinc oxide, strontium oxide, aluminum oxide, calcium oxide, magnesium oxide, cerium oxide, mixed oxides thereof, and the like. Silica and titania are favorable among them, from the viewpoints of the particle diameter, grain size distribution, and ease of production.

The amount of these metal oxide particles added to the toner is not particularly limited, but preferably is in a range of about 0.1 to 10% by weight. More specifically, the amount of addition is in a range of about 0.2 to 8% by weight.

If the addition amount is less than 0.1% by weight, the advantageous effects of addition of the metal oxide particles and the like are less observable, and not sufficient to suppress crystallization of the releasing agent on the surface of fixed images. Similarly, it is not favorable if the amount is over 10%, as more metal oxide particles undergo desertion from the toner, adher to the surface of the photoreceptor (so-called filming) and consequently the photoreceptor can be damaged.

From the viewpoints of stabilizing the electrostatic propensity and developing property of the resulting toner, the surface of these metal oxide particles is preferably modified, for example, to be more hydrophobic. Any one of the known surface finish methods may be applied to the surface modification. Specifically, the methods include coupling treatments with silane, titanate, aluminate, or the like.

The coupling agent used for the coupling treatment is not particularly limited, and favorable examples thereof include silane coupling agents such as methyltrimethoxysilane, phenyl trimethoxysilane, methylphenyldimethoxysilane, diphenyldimethoxysilane, vinyltrimethoxysilane, γ-aminopropyltrimethoxysilane, γ-chloropropyltrimethoxysilane, γ-bromopropyltrimethoxysilane, γ-glycidoxypropyltrimethoxysilane, γ-mercaptopropyltrimethoxysilane, γ-ureidopropyltrimethoxysilane, fluoroalkyltrimethoxysilane, and hexamethyldisilazane; titanate coupling agents; aluminate coupling agents; and the like.

With regard to the particle diameter distribution indices of the toner according to the invention, the volume average grain size distribution index GSDv is 1.30 or less, and a ratio of the number-average grain size distribution index GSDp to the volume average grain size distribution index GSDv (GSDp/GSDv) is preferably 0.95 or more.

A volume distribution index GSDv of 1.30 or less indicates that there are both few course and few fine particles contained in the toner, which is favorable for maintaining all of the developing, transfer, and cleaning properties of the resulting toner. If the ratio of the volume average grain size distribution index GSDv to the number-average grain size distribution index GSDp (GSDv/GSDp) is less than 0.95, the electrostatic propensity of such toners may decrease, causing a higher incidence of toner scatter, fogging, and the like, leading to image defects.

The volume average grain size distribution index GSDv and the number-average grain size distribution index GSDp are determined in the following manner. First, based on the grain size distribution data of the toner obtained by using a measuring instrument such as a Coulter counter TAII (trade name, manufactured by Beckman-Coulter Co., Ltd.) or Multisizer II (trade name, manufactured by Beckman-Coulter Co., Ltd.), and the like, the volume and the number of toner particles in each of the previously partitioned grain ranges (channel) are obtained. These are then plotted starting from the smallest to give a cumulative distribution curve, and the particle diameters at a cumulative point of 16% are defined respectively as volume-average particle diameter D16v and number-average particle diameter D16p. Similarly those at a cumulative point of 50%, are defined as volume-average particle diameter D50v and number-average particle diameter D50p, and the particle diameters at a cumulative point of 84% are defined respectively as volume-average particle diameter D84v and the number-average particle diameter D84p. The volume average grain size distribution index (GSDv) is defined as D84v/D16v, and the number-average grain size distribution index (GSDp), D84p/D16p. The volume average grain size distribution index (GSDv) and the number-average grain size distribution index (GSDp) can be calculated with these formulae.

The surface area of the toner for developing electrostatic latent images according to the invention is not particularly limited, and any toners having a surface area in the range suitable for use as a common toner may be used. Specifically, the surface area is preferably in a range of about 0.5 to 10 $m^2/g$, more preferably in a range of about 1.0 to 7 $m^2/g$, and still more preferably in a range of about 1.2 to 5 $m^2/g$, as determined by the BET method. The surface area is particularly preferably in a range of about 1.2 to 3 $m^2/g$.

Electrostatic Latent Image Developer

The electrostatic latent image developer according to the invention is not particularly limited. As long as it contains a toner for developing electrostatic latent images according to the invention it may have any suitable composition according to its application. The electrostatic latent image developer according to the invention contains at least a toner, and thus includes unicomponent electrostatic latent image developers, wherein only the toner for developing electrostatic latent images according to the invention is used, and two-component electrostatic latent image developers, containing the toner in combination with a carrier.

When a carrier is used the carrier is not particularly limited, and could include known carriers, such as resin-coated carriers described and the like, for example, in JP-A Nos. 62-39879 and 56-11461, and the like.

Specific examples of the carriers include the followings resin-coated carriers. Core particles for the resin-coated carriers include common iron powders, ferrite and magnetite, and the like, and the volume-average particle diameter thereof is in a range of about 30 to 200 μm.

Examples of the coating resins for the resin-coated carrier include homopolymers from a monomer and copolymers from two or more monomers including: styrenes such as styrene, p-chlorostyrene, and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acrylics such as dimethylaminoethyl methacrylate and the like; vinyl nitrites such as acrylonitrile and methacrylonitrile; vinyl pyridines such as 2-vinylpyridine and 4-vinylpyridine; vinyl ethers such as vinylmethylether and vinylisobutylether; vinyl ketones such as vinylmethylketone, vinylethylketone, and vinylisopropenylketone; olefins such as ethylene and propylene; fluorine-containing vinyl monomers such as vinylidene fluoride, tetrafluoroethylene, and hexafluoroethylene; as well as silicone resins containing methylsilicone, methylphenylsilicone or the like; polyesters containing bisphenol, glycol, or the like; epoxy resins, polyurethane resins, polyamide resins, cellulose resins, polyether resins, polycarbonate resins, and the like. These resins may be used alone or in combination of two or more. The amount of the coating resin used is preferably in a range of about 0.1 to 10 parts by weight, more preferably in a range of about 0.5 to 3.0 parts by weight, with respect to 100 part by weight of the core particles.

The resin-coated carriers may be produced in a heating kneader, heating Henschel mixer, UM mixer, or the like, or in a heated fluidized bed, heated kiln, or the like, depending on the amount of the coating resin.

When the electrostatic latent image developer according to the invention is a two-component electrostatic latent image developer system, the mixing ratio of the toner for developing electrostatic latent images according to the invention to the carrier is not particularly limited, and may be suitably selected according to the application.

EXAMPLES

Hereinafter, the present invention will be described in more detail with reference to Examples, but it should be understood that the invention is not restricted to these Examples. In the description below, the "parts" means "parts by weight", unless otherwise specified.

Methods of Measuring Various Properties

First, the method of measuring and evaluating each of the properties of toners and developers used in the following Examples and Comparative Examples will be described.

Arithmetical Mean Undulation Height of the Surface of the Toner Particles at the 90% Point on the Cumulative Distribution Curve (Lubricity)

The arithmetical mean undulation height of the surface of the toner particles at the 90% point on the cumulative distribution curve is determined by using a ultra-depth color 3D profile microscope, VK-9500, manufactured by Keyence. This microscope scans the surface of a sample three-dimensionally by irradiating a laser beam. The three-dimensional surface information of the sample is obtained by monitoring by a CCD camera the laser beam reflected at each site on the sample. The surface data thus obtained are statistically processed, to give the indicator concerning the surface roughness.

In the invention, under the condition of a power of the lens of 3,000 and a laser scanning pitch of 0.01 μm in the height direction (Z axis), the microscope scans three-dimensionally over an area of 2 μm square in the horizontal plane (plane of X and Y axes) on the surface of a toner particle surface, and the arithmetical mean undulation height of the surface of the toner particles at the 90% point on the cumulative distribution curve is determined. The surface roughness is obtained, by using 0.3 as γ for γ correction and performing uniformization of height once for noise-cut analysis during the measurement. The same measurements are repeated using 1,000 toner particles, and the resulting data are statistically processed to give the arithmetical mean undulation height of the surface of the toner particles at the 90% point on the cumulative distribution curve.

Volume-Average Particle Diameters of Resin Particles, Colorant Particles, and Releasing Agent Particles The volume-average particle diameters of resin particles, colorant particles, and releasing agent particles are determined by using a laser-diffraction grain size distribution-measuring device (trade name: LA-700, manufactured by Horiba, Ltd.).

Method of Measuring the Volume-Average Particle Diameter and the Grain Size Distribution of Toner Particles The toner volume-average particle diameter and the particle diameter distribution index according to the invention are determined by using a Coulter counter TAII (trade name, manufactured by Beckman Coulter, Inc.) and an electrolyte, ISOTON-II (trade name, manufactured by Beckman Coulter, Inc.).

In measurement, 0.5 to 50 mg of a test sample is added into a 2-ml 5% aqueous solution containing a surfactant, preferably sodium alkylbenzenesulfonate, as the dispersant, and the mixture is added into 100 to 150 ml of the electrolyte above. After sonication of the test sample-dispersed electrolyte in an ultrasonic dispersing machine for about 1 minute, the grain size distribution of the particles having a particle diameter in a range of about 0.6 to 18 μm is determined by using an aperture having a diameter of 30 μm in the Coulter counter TA-II.

When a cumulative distribution curve is drawn from the data about the grain size distribution thus obtained by allocating the volume and the number of particles into partitioned grain ranges (channel) from the smallest side, the particle diameters at a cumulative point of 16% are designated respectively as volume-average particle diameter D16v and number-average particle diameter D16p, and the particle diameters at a cumulative point of 50% are designated respectively as volume-average particle diameter D50v (the volume-average particle diameter of toner particles described above) and number-average particle diameter D50p. In a similar manner, the particle diameters at a cumulative point of 84% are designated respectively as volume-average particle diameter D84v and number-average particle diameter D84p. The volume average grain size distribution index (GSDv), D84v/D16v, is calculated using these values.

Method of Measuring Toner Particles and the Toner Shape Factor

The toner shape factor SF1 is determined by incorporating direct images or optical microscope images of toner particles spread on a slide glass via a video camcorder into a Luzex image-analyzing instrument; measuring the maximum lengths and the projected areas of 50 or more toner particles; calculating according to the following Formula (2); and obtaining the average thereof:

$$SF1=(ML^2/A)\times(\pi/4)\times 100 \qquad \text{Formula (2)}$$

In the Formula (2), ML represents the absolute maximum length of a toner particle, and A represents the projected area of the toner particle.

Method of Measuring the Molecular Weight and the Molecular-Weight Distribution of Toner and Resin Particles The molecular weights and the molecular-weight distributions of the toner for developing electrostatic latent images and the resin particle according to the inventions are determined by gel-permeation chromatography (GPC). The GPC apparatus used is HLC-8120 GPC, SC-8020 (trade name, manufactured by Tosoh Corp.) equipped with two columns, TSK gel and SuperHM-H (trade name, manufactured by Tosoh Corp., 6.0 mm ID×15 cm), wherein tetrahydrofuran (THF) is used as the eluent. In a typical experiment, the sample concentration is 0.5% by weight; the flow rate, 0.6 ml/min; the sample injection, 10 μl; and the measuring temperature, 40° C. An IR detector is used for measurement. The calibration curve is prepared by using 10 polystyrene standard sample: TSK Standards": "A-500", "F-1", "F-10", "F-80", "F-380", "A-2500", "F-4", "F-40" "F-128", and "F-700", manufactured by Tosoh Corp.

Glass Transition Points of Toner and the Resin Particles, and Melting Points of Releasing Agent The glass transition points of toners and the resin particles, and the melting points of releasing agents are determined by using a differential scanning calorimeter (trade name: DSC-50, manufactured by Shimadzu Corporation) under the condition of a temperature increase at a rate of 3° C./min. The glass transition point is a temperature at the intersection of the baseline and the extension of the rising line of the DSC curve in the endothermic region, while the melting point is a temperature at the point of endothermic peak.

Surface Area of Toners

The surface area of toners (BET surface area) is determined by using a specific surface area-micropore distribution analyzer (trade name: Coulter SA3100, manufactured by Beckman Coulter, Inc.).

Preparation of Dispersions

First, each dispersion for preparation of toner particles is prepared as described below.

Preparation of Resin Particle Dispersion A

- Styrene (manufactured by Wako Pure Chemical Industries, Ltd.): 330 parts
- n-Butyl acrylate (manufactured by Wako Pure Chemical Industries, Ltd.): 80 parts
- β-Carboxyethyl acrylate (manufactured by Rhodia Nicca, Ltd.): 9 parts
- 1,10-Decanediol diacrylate (manufactured by Shin-Nakamura Chemical Co., Ltd.): 1.5 parts
- Dodecanethiol (manufactured by Wako Pure Chemical Industries, Ltd.): 3.0 parts A mixture of the components above are poured into a flask containing a solution of 4 parts of an anionic surfactant DOW-FAX (trade name: manufactured by Dow Chemical Company) in 550 parts of ion-exchange water, and the resulting mixture is dispersed and emulsified. A solution of 6 parts of ammonium persulfate in 50 parts of ion-exchange water is added thereto slowly over 10 minutes while the mixture is stirred.

Then, after the flask is purged with nitrogen sufficiently, the flask is heated in an oil bath until the internal temperature reaches 70° C. while the mixture is stirred, and the mixture is heated at the same temperature for 5 hours to continue emulsion polymerization.

In this manner, an anionic resin particle dispersion A (solid matter content: 43% by weight) containing resin particles having a volume-average particle diameter of 180 nm, a glass transition point of 53° C., and a weight-average molecular weight Mw of 33,000 is obtained.

Preparation of Resin Particle Dispersion B

- Styrene (manufactured by Wako Pure Chemical Industries, Ltd.): 330 parts
- n-Butyl acrylate (manufactured by Wako Pure Chemical Industries, Ltd.): 70 parts
- Acrylic acid (manufactured by Wako Pure Chemical Industries, Ltd.): 9 parts
- 1,10-Decanediol diacrylate (manufactured by Shin-Nakamura Chemical Co., Ltd.): 2 parts
- Dodecanethiol (manufactured by Wako Pure Chemical Industries, Ltd.): 3 parts A mixture of the components above is poured into a flask containing a solution of 6 parts of a nonionic surfactant (trade name: Nonipol 400, manufactured by Sanyo Chemical Industries, Ltd.) and 10 parts of an anionic surfactant (trade name: Neogen R, manufactured by Daiichi Kogyo Seiyaku Co., Ltd.) in 550 parts of ion-exchange water, and the resulting mixture is dispersed and emulsified. A solution of 4 parts of ammonium persulfate in 50 parts of ion-exchange water is then added thereto slowly over 10 minutes while the mixture is stirred. Subsequently, after the flask is purged with nitrogen sufficiently, the flask is heated in an oil bath until the internal temperature reaches 75° C., and the mixture is heated at the same temperature for 5 hours to complete polymerization.

In this manner, a resin particle dispersion B (solid matter content: 44% by weight) containing resin particles having a volume-average particle diameter of 200 nm, a glass transition point of 55° C., and a Mw of 28,000 is obtained.

Preparation of Colorant Particle Dispersion A

- Carbon black (trade name: R330, manufactured by Cabot): 50 parts
- Ionic surfactant (trade name: Neogen RK, manufactured by Dai-ichi Kogyo Seiyaku Co., Ltd.): 4 parts
- Ion-exchange water: 250 parts A mixture of the components above is dispersed in a homogenizer (trade name: Ultra-Turrax T50, manufactured by IKA) for 10 minutes, and then sonicated with 28-kHz ultrasonic wave in an ultrasonic dispersing machine for 10 minutes, to give a colorant particle dispersion A containing colorant particles having a volume-average particle diameter of 150 nm.

Preparation of Colorant Particle Dispersion B

- Copper phthalocyanine pigment (manufactured by BASF Japan Ltd.): 50 parts
- Ionic surfactant (trade name: Neogen SC, manufactured by Dai-ichi Kogyo Seiyaku Co., Ltd.): 8 parts
- Ion-exchange water: 250 parts A mixture of the components above is dispersed in a homogenizer (trade name: Ultra-Turrax T50, manufactured by IKA) for 10 minutes, and then sonicated in an ultrasonic dispersing machine for 20 minutes, to give a colorant particle dispersion B containing colorant particles having a volume-average particle diameter of 180 nm.

Preparation of Releasing Agent Particle Dispersion A

- Polyethylene wax (melting point: 88° C., trade name: Poly Wax 500, manufactured by Toyo-Petrolite): 50 parts
- Ionic surfactant (trade name: Neogen RK, manufactured by Dai-ichi Kogyo Seiyaku Co., Ltd.): 5 parts
- Ion-exchange water: 200 parts A mixture of the components above is heated to 95° C., and dispersed sufficiently in the Ultra-Turrax T50 manufactured by IKA and additionally in a high-pressure extrusion-type Gaulin homogenizer, to give a releasing agent particle dispersion A (solid matter content: 25% by weight) containing releasing agent particles having a volume-average particle diameter of 250 nm.

Preparation of Releasing Agent Particle Dispersion B

A releasing agent particle dispersion B containing releasing agent particles having a volume-average particle diameter of 210 nm is prepared in the similar manner to the releasing agent particle dispersion A, except that the polyethylene wax (trade name: Poly Wax 500, manufactured by Toyo-Petrolite) used in the preparation of releasing agent particle dispersion A is replaced with a paraffin wax (melting point: 90.2° C., trade name: FNP0090, manufactured by Nippon Seiro Co., Ltd.).

Preparation of Releasing Agent Particle Dispersion C

A releasing agent particle dispersion C containing releasing agent particles having a volume-average particle diameter of 200 nm is prepared in the similar manner to the releasing agent particle dispersion A, except that the polyethylene wax (trade name: Poly Wax 500, manufactured by Toyo-Petrolite) used in the preparation of releasing agent particle dispersion A is replaced with a paraffin wax (melting point: 75° C., trade name: HNP09, manufactured by Nippon Seiro Co., Ltd.).

Preparation of Releasing Agent Particle Dispersion D

A releasing agent particle dispersion D containing releasing agent particles having a volume-average particle diameter of 250 nm is prepared in the similar manner to the releasing agent particle dispersion A, except that the polyethylene wax (trade name: Poly Wax 500, manufactured by Toyo-Petrolite) used in the preparation of releasing agent particle dispersion A is replaced with a paraffin wax (melting point: 113° C., trade name: FNP0115, manufactured by Nippon Seiro Co., Ltd.).

Preparation of Releasing Agent Particle Dispersion E

A releasing agent particle dispersion E containing releasing agent particles having a volume-average particle diameter of 250 nm is prepared in the similar manner to the releasing agent particle dispersion A, except that the polyethylene wax (trade name: Poly Wax 500, manufactured by Toyo-Petrolite) used in the preparation of releasing agent particle dispersion A is replaced with a polypropylene wax (melting point: 113° C., trade name: H10254, manufactured by Clariant).

Example 1

Preparation of Toner Particles A

Resin particle dispersion A: 80 parts

Colorant particle dispersion A: 30 parts

Releasing agent particle dispersion B: 30 parts

Polyaluminum chloride: 0.4 part

The ingredients above are placed in a round-bottom stainless steel flask and mixed and dispersed by the Ultra-Turrax T50 manufactured by IKA. Then, 0.6 parts of polyaluminum chloride is added, and the mixture is additionally dispersed by the Ultra-Turrax T50. The flask is then heated to 50° C. in a heating oil bath while the mixture is stirred. After the mixture is kept at 50° C. for 60 minutes, 40 parts of the resin particle dispersion A is added gradually.

After the pH of the mixture is adjusted to 5.5 with 0.5 mol/L aqueous sodium hydroxide solution, the stainless steel flask is sealed tightly and the mixture is heated to 95° C. while continuously stirred with a magnetic stirrer and kept at the same temperature for 5 hours. During the heating, the solution is adjusted with 0.5 mol/L sodium hydroxide or 0.5 mol/L nitric acid so that the particles therein have shape factor SF1 of 132.

After reaction, the mixture is cooled and filtered. The particles thus separated are washed thoroughly with ion-exchange water, and filtered with a Nutsche filter under reduced pressure for separation of water. The particles are then redispersed in 3 L of ion-exchange water at 40° C., and stirred and washed therein for 15 minutes while stirred at 300 rpm. The washing procedures above are repeated five times, until the pH of the filtrate becomes 6.6 and the electric conductivity 12 μS/cm. The particles are filtered through a No. 5A filter paper in a Nutsche filter to remove the water. The particles are then dried under vacuum for 12 hours.

The particle diameter of the toner particles A thus obtained is determined by using a Coulter counter. The volume average diameter D50v is 6.6 μm. In addition, the volume average grain size distribution index GSDv is 1.21.

Preparation of Toner A and Developer A 0.8 part of titania having a volume average particle diameter of 30 nm modified with isobutyltrimethoxysilane and 1.5 parts of silica having a volume average particle diameter of 50 nm modified with hexamethyldisilazane are added as external additives to the toner particles A thus obtained, with respect to 100 parts of the toner particles, and the mixture is blended in a 5L Henschel mixer (manufactured by Mitsui Miike Machinery) for 10 minutes, and then screened with a Gyro Shifter (mesh opening: 45 μm), to give a toner A.

To 7 parts of the toner A obtained, 93 parts of a carrier, which is previously prepared by coating a silicone resin (SR2411, manufactured by Toray Dow Corning Silicone) in an amount of 0.8% by weight on a ferrite core having a volume-average particle diameter of 50 μm in a kneader, is added and the mixture is blended in a V-type blender, to give a developer A.

Example 2

Preparation of Toner Particles B

Resin particle dispersion B: 80 parts

Colorant particle dispersion B: 30 parts

Releasing agent particle dispersion B: 30 parts

The dispersions above are placed in a round-bottom stainless steel flask and adjusted to a temperature of 20° C. while stirred. After the pH of the mixture is adjusted to 5 with 0.5 mol/L aqueous sodium hydroxide solution, the mixture is heated to 48° C. in a heating oil bath while continuously stirred with the Ultra-Turrax T50, to give a dispersion containing particles having a volume-average particle diameter of 4 μm. Subsequently, 40 parts of the resin particle dispersion B is added and the pH of mixture is further adjusted to 2.

Subsequently, the mixture is stirred without temperature adjustment for 2 hours allowing the particles to grow in size, and when the volume-average particle diameter of the particles reaches 6.6 μm, the pH of the mixture is adjusted to 6. The mixture is then reheated to 98° C. and kept at the same temperature for 5 hours. During heating, the mixture is adjusted with 0.5 mol/L sodium hydroxide or 0.5 mol/L nitric acid so that the shape factor SF1 thereof became 130.

After reaction, the mixture is cooled and filtered. The resulting particles are washed thoroughly with ion-exchange water and then filtered with a Nutsche filter under reduced pressure to remove the water. The particles are then redispersed in 3 L of ion-exchange water at 40° C., and washed therein while the mixture is stirred at 300 rpm for 15 minutes. The washing procedures above are repeated five times, until the pH of the filtrate becomes 6.6 and the electric conductivity 12 μS/cm. The particles are filtered through a No.5A filter paper in a Nutsche filter to remove the water. The particles are then dried under vacuum for 12 hours.

The particle diameter of the toner particles A thus obtained is determined by using a Coulter counter. The volume average diameter D50v is 6.7 μm. The volume average grain size distribution index GSDv is 1.26.

Preparation of Toner B and Developer B

A toner B and a developer B are prepared in the similar manner to Example 1 from the toner particles B obtained.

Example 3

Preparation of Toner Particles C

Toner particles C having a shape factor SF1 of 140, a volume-average particle diameter D50v of 6.5 μm, and a GSDv of 1.22 are prepared in the similar manner to the toner particles A, except that the releasing agent particle dispersion B used in the preparation of toner particles A in Example 1 is replaced with the releasing agent particle dispersion A, and the coalescing temperature and the coalescing time are changed respectively to 98° C. and 5.5 hours.

Preparation of Toner C and Developer C

A toner C and a developer C are prepared in the similar manner to Example 1 from the toner particles C obtained.

Example 4

Preparation of Toner Particles D

Toner particles D having a shape factor SF1 of 125, a volume-average particle diameter D50v of 6.6 μm, and a GSDv of 1.20 are prepared in the similar manner to the toner particles A, except that the releasing agent particle dispersion B used in the preparation of toner particles A in Example 1 is replaced with the releasing agent particle dispersion C and the coalescing time is changed to 6 hours.

Preparation of Toner D and Developer D

A toner D and a developer D are prepared in the similar manner to Example 1 from the toner particles D obtained.

Example 5

Preparation of Toner Particles E

Toner particles E having a shape factor SF1 of 130, a volume-average particle diameter of 6.7 μm, and a GSDv of 1.27 are prepared in the similar manner to the toner particles B, except that the releasing agent particle dispersion B used in the preparation of toner particles B in Example 2 is replaced with the releasing agent particle dispersion D and the round-bottom stainless steel flask, a stainless steel pressure container; the reheating temperature is changed from 98° C. to 120° C.; and the coalescing time is changed to 4 hours.

Preparation of Toner E and Developer E

A toner E and a developer E are prepared in the similar manner to Example 1 from the toner particles E obtained.

Example 6

Preparation of Toner Particles F

Toner particles F having a shape factor SF1 of 130, a volume-average particle diameter D50v of 6.8 μm, and a GSDv of 1.27 are prepared in the similar manner to the toner particles E, except that the releasing agent particle dispersion D used in the preparation of toner particles E in Example 5 is replaced with the releasing agent particle dispersion E and the coalescing time is changed to 15 hours.

Preparation of Toner F and Developer F

A toner F and a developer F are prepared in the similar manner to Example 1 from the toner particles F obtained.

Comparative Example 1

Preparation of Toner Particles G

Toner particles G having a shape factor SF1 of 130, a volume-average particle diameter D50v of 6.4 μm, and a GSDv of 1.21 are prepared in the similar manner to the toner particles A, except that the round-bottom stainless steel flask used in the preparation of toner particles A in Example 1 is replaced with a stainless steel pressure container and the coalescing time is changed to 8 hours.

Preparation of Toner G and Developer G

A toner G and a developer G are prepared in the similar manner to Example 1 from the toner particles G obtained.

Comparative Example 2

Preparation of Toner Particles H

Toner particles H having a shape factor SF1 of 125, a volume-average particle diameter D50v of 6.8 μm, and a GSDv of 1.21 are prepared in the similar manner to the toner particles C, except that the coalescing time in the preparation of toner particles C in Example 3 is changed to 10 hours.

Preparation of Toner H and Developer H

A toner H and a developer H are prepared in the similar manner to Example 1 from the toner particles H obtained.

Comparative Example 3

Preparation of Toner Particles I

Toner particles I having a shape factor SF1 of 140, a volume-average particle diameter D50v of 6.5 μm, and a GSDv of 1.20 are prepared in the similar manner to the toner particles C, except that the coalescing temperature in the preparation of toner particles C in Example 3 is changed to 92° C.

Preparation of Toner I and Developer I

A toner I and a developer I are prepared in the similar manner to Example 1 from the toner particles I obtained.

Comparative Example 4

Preparation of Toner Particles J

Toner particles J having a shape factor SF1 of 135, a volume-average particle diameter D50v of 7 μm, and a GSDv of 1.23 are prepared in the similar manner to the toner particles A, except that the releasing agent particle dispersion B used in the preparation of toner particles A in Example 1 is replaced with the releasing agent particle dispersion E.

Preparation of Toner J and Developer J

A toner J and a developer J are prepared in the similar manner to Example 1 from the toner particles J obtained.

Comparative Example 5

Preparation of Toner Particles K

Toner particles K having a shape factor SF1 of 140, a volume-average particle diameter D50v of 6.2 μm, and a GSDv of 1.26 are prepared in the similar manner to the toner particles B, except that the releasing agent particle dispersion B used in the preparation of toner particles B in Example 2 is replaced with the releasing agent particle dispersion D.

Preparation of Toner K and Developer K

A toner K and a developer K are prepared in the similar manner to Example 1 from the toner particles K obtained.

Comparative Example 6

Toner particles L having a volume-average particle diameter D50v of 7.5 μm, and a GSDv of 1.20 are prepared in the similar manner to toner particles A, except that the shape factor SF1 used for control of the particle shape during coalescing in the preparation of toner particles A in Example 1 is changed to 150.

Preparation of Toner L and Developer L

A toner L and developer L are prepared in the similar manner to Example 1 from the toner particles L obtained.

Comparative Example 7

Preparation of Toner Particles M

Toner particles M having a volume-average particle diameter D50v of 5.3 μm and a GSDv of 1.26 are prepared in the similar manner to the toner particles B, except that the shape factor SF1 used for control of the particle shape during coalescing in the preparation of toner particle B in Example 2 is changed to 120.

Preparation of Toner M and Developer M

A toner M and a developer M are prepared in the similar manner to Example 1 from the toner particles M obtained.

Comparative Example 8

Preparation of Toner Particle N

Binder resin (styrene-acrylic copolymer; copolymerization ratio: 80/20; weight-average molecular weight: 105,000; and Tg: 65° C.): 43 parts.

Magnetite (hexahedron, volume-average particle diameter: 0.10/μm): 50 parts

Charge controlling agent (trade name: Bontron E84, manufactured by Orient Chemical Industries): 2 parts Paraffin wax (melting point: 85° C., trade name: FNP0085, manufactured by Nippon Seiro Co., Ltd.): 5 parts The ingredients above are mixed in a Henschel mixer, and then melt-kneaded in a continuous kneader (extruder TEM50, manufactured by Toshiba Machine) at a predetermined temperature of 140° C., a screw rotational frequency of 300 rpm, and a feed speed of 100 kg/h. The mixture is then crushed into fine powders in a jet mill (trade name: 400AFG and coarse powder classifier 200ATP, both manufactured by Hosokawamicron Corporation), and the powders are classified in an air classifier (trade name: TC40, manufactured by Nissin Engineering) (intake air temperature: 25° C.), to give toner particles N.

The shape factor SF1 of the toner particles N is 142; the volume-average particle diameter, 7.6 μm; and the GSDv, 1.27.

EXAMPLE 7

Preparation of Toner Particles O

Toner particles O are prepared in the similar manner to the preparation of toner particles N, except that intake air temperature during the classification in the preparation of toner particles N in Comparative Example 8 is changed to 50° C.

The shape factor SF1 of the toner particles O is 138; the volume-average particle diameter, 7.6 μm, and the GSDv, 1.27.

Comparative Example 9

Preparation of Toner Particles P

Toner particles P are prepared in the similar manner to the preparation of toner particles O, except that the paraffin wax (FNP0085) used in the preparation of toner particles O in Example 7 is replaced with a polyethylene wax (melting point: 113° C.; PW1000, manufactured by Toyo-Petrolite).

The shape factor SF1 of the toner particles P is 138; the volume-average particle diameter, 8.0 μm, and the GSDv, 1.27.

Evaluation of Toners and Developers in a Commercial Apparatus

Fixability

Unfixed images are formed with the developers A to M by using a modified A-Color 935 image forming apparatus from which the fixing unit is removed, and fixed at processing speeds of 90 and 460 mm/sec by using a modified Docucolor 500 fixing apparatus operable at variable processing speeds, and the results are evaluated according to the following criteria:

Minimum Fixing Temperature (MFT)

A: Lower than 140° C.

B: In a range of 140 to 160° C.

C: In a range of 160 to 180° C.

D: Higher than 180° C.

High-Temperature Offset Temperature (HOT)

A: Higher than 250° C.

B: In a range of 230 to 250° C.

C: In a range of 210 to 230° C.

D: Lower than 210° C.

Cleaning Property

The cleaning property of untransferred images is tested with the developers A to M at processing speeds of 100 and 450 mm/sec by using a cleaning bench (transfering unit removable) in a modified Docucolor 500 operable at variable processing speeds, and is evaluated according to the following criteria:

A: Untransferred highly charged toner cleanable.

B: Residual toner after transfer easily cleanable.

C: There are some thick lines uncleanable but practically no problem in image quality.

D: There are problems in image quality.

Consistency in Image Quality

A test on the consistency in image quality is conducted, wherein 100,000 copies of images are formed with the developers A to M by using a modified printing machine (trade name: DocuColor 500, manufactured by Fuji Xerox Co., Ltd.) under an environment of 20° C. and 50% RH. The image quality, fogging, black lines, and charge consistency of the printed image after printing 100,000 copies are evaluated according to the following criteria:

Image Quality

A: Excellent in thin line reproducibility.

B: Better in thin line reproducibility.

C: Not satisfactory in thin line reproducibility, but there are practically no problem.

D: Problems in reproducibility.

Fogging

A: No fogging on photoreceptor.

B: Some fogging observable on photoreceptor.

C: Fogging observable on photoreceptor, but no fogging on image-transferred paper.

D: Some fogging on image-transferred paper.

Black Line

A: No black line.

B: Some black lines on photoreceptor, but no problem.

C: Many black lines on photoreceptor, but not on image-transferred paper.

D: Some black line on image-transferred paper.

Charge Consistency

The charge consistency is evaluated according to the following criteria, when ΔTP is defined as ΔTP=(amount of static charge×toner concentration after printing 100,000 copies)/(initial amount of static charge× initial toner concentration):

The amount of static charge on the toner is determined by collecting the toner on sleeve and measuring the charge of the toner according to the blow off method (analyzer: TB200, manufactured by Toshiba Chemical).

A: ΔTP in a range of 0.8 to 1.2.

B: ΔTP in a range of 0.65 to 0.8.

C: ΔTP in a range of 0.5 to 0.65.

D: ΔTP less than 0.5.

The results above are summarized together with the properties of the toner particles A to M in Tables 1 and 2.

TABLE 1

| | Toner | Releasing agent particle dispersion | Tm (° C.) | Tf (° C.) | t (min) | D50 (μm) | SF1 | GSDv | Arithmetical mean undulation height of the surface of the toner particles at the 90% point on the cumulative distribution curve (μm) | P |
|---|---|---|---|---|---|---|---|---|---|---|
| Example 1 | A | B | 90 | 95 | 300 | 6.6 | 132 | 1.21 | 0.20 | 278 |
| Example 2 | B | B | 90 | 98 | 480 | 6.7 | 130 | 1.25 | 0.18 | 266 |
| Example 3 | C | A | 88 | 98 | 330 | 6.5 | 140 | 1.22 | 0.25 | 289 |
| Example 4 | D | C | 75 | 95 | 360 | 6.6 | 125 | 1.20 | 0.15 | 245 |
| Example 5 | E | D | 113 | 120 | 240 | 6.7 | 138 | 1.26 | 0.22 | 290 |
| Example 6 | F | E | 113 | 120 | 900 | 6.8 | 130 | 1.27 | 0.17 | 259 |
| Comparative Example 1 | G | B | 90 | 120 | 480 | 6.4 | 130 | 1.21 | 0.11 | 235 |
| Comparative Example 2 | H | C | 75 | 95 | 600 | 6.8 | 125 | 1.21 | 0.10 | 231 |
| Comparative Example 3 | I | A | 88 | 92 | 300 | 6.5 | 140 | 1.20 | 0.27 | 296 |
| Comparative Example 4 | J | E | 113 | 95 | 300 | 7.0 | 135 | 1.23 | 0.28 | 305 |
| Comparative Example 5 | K | D | 113 | 98 | 480 | 6.2 | 140 | 1.26 | 0.30 | 321 |
| Comparative Example 6 | L | B | 90 | 95 | 300 | 7.5 | 150 | 1.20 | 0.26 | 305 |
| Comparative Example 7 | M | B | 90 | 98 | 480 | 5.3 | 120 | 1.26 | 0.15 | 240 |

TABLE 2

| | Cleaning property | | Fixability 100 mm/sec | | Fixability 450 mm/sec | | Consistency (after printing 100,000 copies) | | | | |
|---|---|---|---|---|---|---|---|---|---|---|---|
| | 100 mm/sec | 450 mm/sec | MFT | HOT | MFT | HOT | Image quality | Fogging | Black line | Charge consistency | Overall judgment |
| Example 1 | A | A | A | A | B | A | A | A | A | A | A |
| Example 2 | A | B | A | A | B | A | B | C | A | C | B |
| Example 3 | A | A | A | B | B | B | B | B | A | B | B |
| Example 4 | B | B | A | B | B | B | A | B | B | A | B |
| Example 5 | A | A | B | C | B | B | B | C | B | C | B |
| Example 6 | A | A | B | C | B | B | B | C | B | C | B |
| Comparative Example 1 | C | D | A | A | B | A | A | B | D | B | D |
| Comparative Example 2 | D | D | B | B | B | B | B | B | D | A | D |
| Comparative Example 3 | A | A | B | B | C | B | C | D | A | C | D |
| Comparative Example 4 | B | B | C | D | C | D | C | D | B | C | D |
| Comparative Example 5 | A | B | C | D | C | C | C | D | A | D | D |
| Comparative Example 6 | A | A | B | B | B | B | D | D | A | B | D |

TABLE 2-continued

| | Cleaning property | | Fixability 100 mm/sec | | Fixability 450 mm/sec | | Consistency (after printing 100,000 copies) | | | | Overall |
|---|---|---|---|---|---|---|---|---|---|---|---|
| | 100 mm/sec | 450 mm/sec | MFT | HOT | MFT | HOT | Image quality | Fogging | Black line | Charge consistency | judgment |
| Comparative Example 7 | C | D | A | A | B | A | A | D | D | D | D |

In addition, the initial fixing characteristic, cleaning characteristic, and consistency in image quality after printing 20,000 copies are evaluated, by using the toners N, O, and P as the developer in the image forming apparatus shown in FIG. 1.

The image forming apparatus shown in FIG. 1 has a cylindrical organic photoreceptor formed on a SUS base material having a external diameter of 15 mm as the photoreceptor (latent image bearing body) 1 and an aluminum developing roll of 10 mm in external diameter containing a 720G magnet therein as the toner carrier 3. The developing roll 3 is pressed at a linear pressure of 30 g/cm by a silicone rubber layer-forming blade 4 for forming a thin layer of toner. The photoreceptor 1 and the developing roll 3 are separated from each other by a distance of 250 μm. The photoreceptor 1 is electrostatically charged by a roller-charging device 2 to −350 V, and then exposed to a laser beam, forming an electrostatic latent image thereon. The latent image is developed by applying an a.c. voltage at a frequency of 2.1 kHz and a Vpp of 2.2 kV and a d.c. voltage of −250 V to the developing roll 3. The peripheral velocity of the photoreceptor 1 is 90 mm/sec, and the peripheral velocity of the developing roll 3 is 100 mm/sec. The toner is transferred by a roller-transferring unit 5 and the photoreceptor is cleaned by a blade cleaner 6.

The evaluation criteria in each evaluation are the same as those in evaluation of the two-component systems, except the followings:

Fixability

High-Temperature Offset Temperature (HOT)

A: Higher than 250° C.

B: In a range of 225 to 250° C.

C: In a range of 200 to 225° C.

D: Lower than 200° C.

Charge Consistency

The charge consistency is evaluated according to the following criteria, when ΔV is defined as ΔV=Amount of static charge after printing 20,000 copies/Initial amount of static charge.

The amount of static charge on toner is determined by collecting the toner on the developing roll 3 with a suction nozzle into a Faraday gauge.

A: ΔV in a range of 0.8 to 1.2.

B: ΔV in a range of 0.65 to 0.8.

C: ΔV in a range of 0.5 to 0.65.

D: ΔV less than 0.5.

The evaluation results are summarized together with the properties of the toners N, O, and P in Table 3.

TABLE 3

| | Toner | Releasing agent | Tm (° C.) | D50 (μm) | SF1 | GSDv | Arithmetical mean undulation height of the surface of the toner particles at the 90% point on the cumulative distribution curve (μm) |
|---|---|---|---|---|---|---|---|
| Example 7 | O | FNP0085 | 85 | 7.6 | 138 | 1.27 | 0.23 |
| Comparative Example 8 | N | FNP0085 | 85 | 7.6 | 142 | 1.27 | 0.29 |
| Comparative Example 9 | P | PW1000 | 113 | 8.0 | 138 | 1.27 | 0.29 |

| | Cleaning property | | Fixability 90 mm/sec | | Fixability 200 mm/sec | | Consistency (after 100,000-copy printing) | | | | Overall |
|---|---|---|---|---|---|---|---|---|---|---|---|
| | 90 mm/sec | 200 mm/sec | MFT | HOT | MFT | HOT | Image quality | Fogging | Black line | Charge consistency | judgment |
| Example 7 | A | B | A | A | B | A | A | B | A | B | B |
| Comparative Example 8 | C | D | A | A | B | A | D | C | D | C | D |
| Comparative Example 9 | C | D | B | D | D | C | C | B | D | B | D |

In addition, after density adjustment by setting the peripheral velocity of the photoreceptor 1 at 200 mm sec and the peripheral velocity of developing roll 3 at 220 mm/sec, the fixing and cleaning characteristics are evaluated.

What is claimed is:

1. A toner for developing an electrostatic latent image comprising of toner particles comprising a binder resin, a colorant and a releasing agent, wherein:

a volume-average particle diameter of the toner particles is in a range of about 5 μm to 8 μm and an average of shape factor SF1 thereof is in a range of about 125 to 140; and an arithmetical mean undulation height of the surface of the toner particles at the 90% point on the cumulative distribution curve is in a range of about 0.15 μm to 0.25 μm, wherein a ratio of a number-average grain size distribution index GSDp of the toner particles to a volume average grain size distribution index GSDv of the toner particles (GSDp/GSDv) is about 0.95 or more.

2. A toner according to claim 1, wherein the releasing agent has a melting point in a range of about 75 to 100° C.

3. A toner according to claim 1, wherein the releasing agent is a paraffin wax.

4. A toner according to claim 1, wherein the releasing agent contains Fischer-Tropsch wax.

5. A toner according to claim 1, wherein an amount of the releasing agent added is in a range of about 5 to 20% by weight with respect to the total amount of the toner.

6. A toner according to claim 1, wherein a glass transition point of the binder resin is in a range of about 45 to 60° C.

7. A toner according to claim 1, wherein a weight-average molecular weight Mw of the binder resin is in a range of about 15,000 to 60,000.

8. A toner according to claim 1, wherein the toner particles have a water content of about 2% or less by weight.

9. A toner according to claim 1, wherein a volume average grain size distribution index GSDv of the toner particles is about 1.30 or less.

10. A toner according to claim 1, wherein a surface area of the toner particles is in a range of about 0.5 to 10 $m^2/g$ as determined by the BET method.

11. A toner according to claim 1, wherein the toner particles have at least two or more kinds of metal oxide particles on the surface thereof.

12. A toner according to claim 1, wherein the toner particles have metal oxide particles having an average particle diameter of 1 to 40 nm as a primary particle diameter.

13. A toner according to claim 1, wherein the toner particles have surfaces modified to be hydrophobic and metal oxide particles.

14. An electrostatic latent image developer comprising a toner, wherein:

the toner comprising toner particles comprising a binder resin, a colorant and a releasing agent;

a volume-average particle diameter of the toner particles is in a range of about 5 μm to 8 μm, and an average of shape factor SF1 thereof is in a range of about 125 to 140; and an arithmetical mean undulation height of the surface of the toner particles at the 90% point on the cumulative distribution curve is in a range of about 0.15 μm to 0.25 μm wherein a ratio of a number-average grain size distribution index GSDp of the toner particles to a volume average grain size distribution index GSDv of the toner particles (GSDp/GSDv) is about 0.95 or more.

15. A electrostatic latent image developer according to claim 14, containing a resin-coated camer.

16. A method for producing a toner for developing electrostatic latent images, comprising:

mixing a resin particle dispersion, containing resin particles having a volume-average particle diameter of 1 μm or less, a colorant particle dispersion, and a releasing agent particle dispersion;

forming aggregated particles by aggregating the resin particles, the colorant particles, and the releasing agent particles by heating;

forming toner particles by heating and coalescing the aggregated particles at a temperature of the glass transition point of the resin particles or higher, wherein the toner for developing electrostatic latent images includes toner particles comprising a binder resin, a colorant and a releasing agent, a volume-average particle diameter of the toner particles is in a range of about 5 μm to 8 μm, and an average of shape factor SF1 thereof is in a range of about 125 to 140 and, an arithmetical mean undulation height of the surface of the toner particles at the 90% point on the cumulative distribution curve is in a range of about 0.15 μm to 0.25 μm, wherein a ratio of a number-average grain size distribution index GSDp of the toner particles to a volume average grain size distribution index GSDv of the toner particles (GSDp/GSDv) is about 0.95 or more.

17. A method according to claim 16, wherein a bivalent metal salt is used during the forming of the aggregated particles.

18. A method according to claim 16, wherein the parameter P, which is a function of the melting point of the releasing agent Tm, the coalescing temperature Tf, the time for coalescing t, and the average of shape factor SF1 of toner particles, is in the range shown in following formula (1):

$$245P \leqq 290 \quad (1)$$

wherein, P represents $(2.137\times SF1)-(0.003\times(Tf-Tm)\times t)$; the units of Tf and Tm are ° C.; and the unit of t is minutes.

* * * * *